United States Patent [19]

Förster et al.

[11] 4,392,429

[45] Jul. 12, 1983

[54] MULTIPLICATIVE ADJUSTMENT PROVISION AT AN INK FEED REMOTE CONTROL DEVICE

[75] Inventors: Karl-Heinz Förster, Dresden; Hans Johne, Radebeul, both of German Democratic Rep.

[73] Assignee: Veb Kombinat Polygraph "Werner Lamberz" Leipzig, Leipzig, German Democratic Rep.

[21] Appl. No.: 328,091

[22] Filed: Dec. 7, 1981

[30] Foreign Application Priority Data

Dec. 12, 1980 [DD] German Democratic Rep. ... 226000

[51] Int. Cl.[3] ..... B41F 31/04

[52] U.S. Cl. ..... 101/365

[58] Field of Search ..... 101/365, 350, 366, 206–208, 101/210; 340/825.37, 825.56, 825.05, 825.06

[56] References Cited

U.S. PATENT DOCUMENTS

| | | | |
|---|---|---|---|
| 3,585,595 | 6/1971 | Slavin | 340/825.05 |
| 3,614,738 | 10/1971 | Slavin | 340/825.56 |
| 3,702,587 | 11/1972 | Lee | 101/207 |
| 3,774,536 | 11/1973 | Raymond et al. | 101/207 |

FOREIGN PATENT DOCUMENTS

| | | | |
|---|---|---|---|
| 2024457 | 1/1980 | United Kingdom | 101/365 |

*Primary Examiner*—J. Reed Fisher

*Attorney, Agent, or Firm*—Michael J. Striker

[57] ABSTRACT

A multiplicative adjustment provision at an ink feed remote control device with a servo system actuating doctor blade support elements. The servo system includes a servo drive and a set point providing section. A control system is connected to the servo system and is provided at its inputs and outputs with multiplexers. The control system includes a motor driven control circuit, a process control unit coordinating with the right sequence the motor control unit successively on the input and output side to the servo system and a first computing circuit preceding the motor control circuit. A difference forming unit has input and output connected to the process control unit and has an output connected to the first computing circuit. A switching means is connected to the difference forming unit and connected to an input multiplexer of the control system. A second computing unit is connected to the motor control unit and to the switching unit.

2 Claims, 2 Drawing Figures

MULTIPLICATIVE ADJUSTMENT PROVISION AT AN INK FEED REMOTE CONTROL DEVICE

BACKGROUND OF THE INVENTION

1. Field of the Invention

The present invention relates to a multiplicative adjustment provision at an ink feed remote control device for printing machines.

2. Brief Description of the Background of the Invention Including Prior Art

A multiplicative adjustment provision at an ink feed remote control device is known from the journal Roland Nachrichten, No. 40 (1979).

It is disadvantageous in the system taught that the multiplicative adjustment provision is provided as a self-contained unit and therefore results in an expensive device.

Also a control provision for a remote control of an ink feed at printing machines has been found (DD file docket WP B 41f/ 220 346), which comprises for the adjustment of the unsteady course of the position of the ductor knife support elements to the steady function of the ductor knife support line upon surpassing of predetermined limiting values, motor control units and a servo system actuating the ductor knife support elements, which servo system comprises a servo drive and set point providing unit, as well as a control system provided at its input and output side with multiplexers, where a single motor control unit, a process control unit coordinating in sequence at the input and output side the motor control unit successively to the servo systems and a difference forming unit connected with its input to the input multiplexer, connected with its input and output to the process control and connected with its output to a computing circuit preceding the motor control unit are forming the control system.

The provision is not provided for either the additive or the multiplicative adjustment at ink feed remote control units.

SUMMARY OF THE INVENTION

1. Purposes of the Invention

It is an object of the present invention to provide for a decrease in the equipment expenditure at ink feed remote control provisions.

It is another object of the present invention to employ the building blocks present in the control provision for an ink feed remote control provision to the adjustment of the unsteady course of the ink knife support elements to the steady function of the ink knife bending line for a multiplicative adjustment provision.

It is a further object of the present invention to provide for adjustment of the ink knife support elements based on set points processed by a computing circuit.

These and other objects and advantages of the present invention will become evident from the description which follows.

2. Brief Description of the Invention

The invention provides a multiplicative adjustment provision at an ink feed remote control device with a servo system actuating the doctor blade support elements. The servo system comprises a servo drive and a set point providing section connected to the servo drive. A control system is connected to the servo system and provided at its inputs and outputs with multiplexers. The control system comprises a motor control circuit, a process control unit coordinating according to the right sequence the motor control unit succesively on the input and output side to the servo system, and a first computing circuit preceding the motor control unit. A difference forming unit has an input and output connected to the process control unit and has its input connected to the first computing circuit. A switching means is connected to the difference forming unit and is connected to an input multiplexer of the control system. A second computing circuit is connected to the motor control unit and to the switching unit.

The second computing circuit can comprise in series connected a second potentiometer connected to the switching unit, a plus-minus switch connected to the second potentiometer, a second operational amplifier connected to the plus minus switch and having an output connected to a storage system, which in turn is connected to the control system.

The novel features which are considered as characteristic for the invention are set forth in particular in the appended claims. The invention itself, however, both as to its construction and its method of operation, together with additional objects and advantagees thereof, will be best understood from the following description of specific embodiments when read in connection with the accompanying drawing.

BRIEF DESCRIPTION OF THE DRAWING

In the accompanying drawing in which is shown one of the various possible embodiments of the present invention.

DESCRIPTION OF INVENTION AND PREFERRED EMBODIMENTS

In accordance with the present invention there is provided a multiplicative adjustment provision for an ink feed remote control device with a servo system actuating doctor blade support elements, which comprises a servo drive and a set point providing unit with a control system having multiplexers at its input and output. The control system comprises a motor control unit, a process control circuit coordinating the motor control unit in proper sequence at the inputs and outputs successively to the set point providing unit and a computing circuit preceding the motor control unit, and a difference forming unit connected with its input and output to the process control unit and with its output to the computing circuit. A second computing circuit is connected in parallel to the difference forming unit, which second computing circuit is connected on its input side to the process control unit and via a switching circuit to the input multiplexer and on its output side to the motor control unit. The second computing group comprises a second potentiometer, a plus-minus switch, a second operational amplifier and a following storage member.

Figure 1:
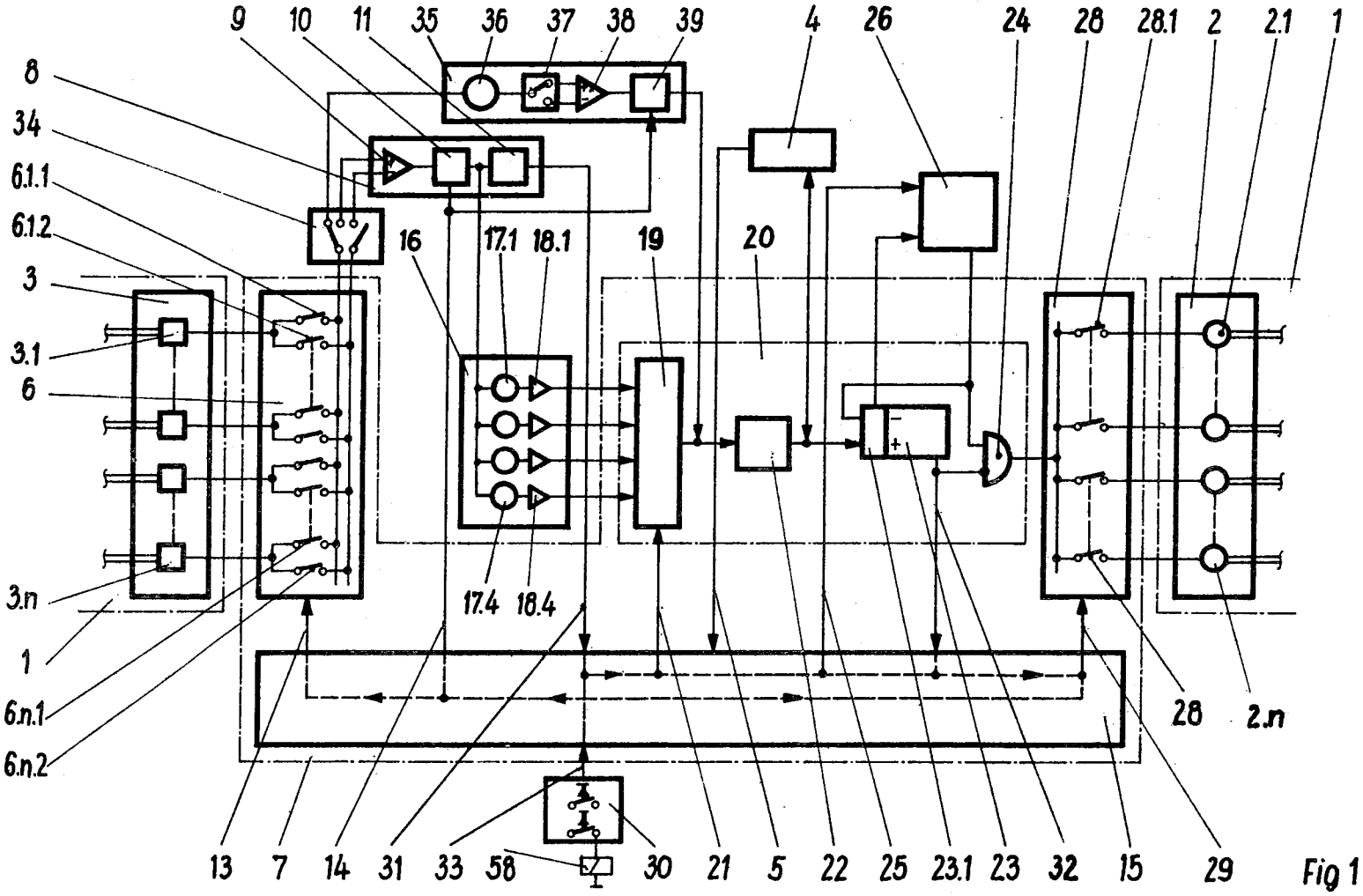
FIG. 1 is a view of a schematic circuit diagram for an ink feed remote control device with a multiplicative adjustment provision.

Referring now to FIG. 1 there is shown a control unit for ink feed remote control device with a multiplicative adjustment provision. The provision serves to the adjustment of servo systems 1, which comprises a function drive 2 such as for example electromotors 2.1 . . . 2.n, and set point providing units 3, such as for example first potentiometers 3.1 . . . 3.n. This provision provides both the adjustment of the unsteady course of the position of the doctor blade support elements to the steady function of the doctor blade bending line as well as the multiplicative adjustment, where preferably all doctor blade support elements are adjusted by a percentage value. Electro-motors 2.1 . . . 2.n and first potentiometers 3.1 . . . 3.n are coupled to each other mechanically. The first potentiometers 3.1 . . . 3.n are connected via two outputs of a first input multiplexer 6 of a first control system 7 and a switching group 34 to a difference forming unit 8, which comprises in a series connection a first difference amplifier 9, a first storage 10 and an amount former 11. The contacts 6.1.2, 6.1.2, . . . 6.n.1, 6.n.2 of the first input multiplexer 6 are controlled by signal A via a first line 13 and the first storage 10 of the difference forming unit 8 is controlled by signal B via a second line 14 of the process control unit 15. The output of the first storage 10 leads to a first computing circuit 16 with coefficient potentiometers 17.1 . . . 17.4 and to first operational amplifiers 18.1 . . . 18.4. The outputs of the first operational amplifiers 18.1 . . . 18.4 of the first computing circuit 16 are connected to a multiplexer 19 controlled by a signal C via a third line 21 of the process control unit 20 and the multiplexer 19 belongs to a first motor control unit 20 of the first servo system.

A second computing circuit 35 is further following to the switching group 34. The computing circuit 35 comprises a second potentiometer 36, a plug-minus switch 37 for assurance of a positive or negative multiplicative adjustment, a second operational amplifier 38 and a storage member 39. The output of the second computing circuit 35 is connected to the output line of the multiplexer 19 of the first motor control unit 20. The storage member 38 is connected to the process control unit 15 via the second line 14.

The output signals of the multiplexer 19 pass via an analog digital converter 22 to a first comparison circuit 23 for set point and servo position. The first comparison circuit 23 is a forward-backward counter with algebraic sign storage 23.1. The output of the first comparison circuit 23 runs to a first AND-gate 24, the second input of which is connected to the first motor pulse providing circuit 26 controlled by the algebraic sign storage 23.1 and the signal D via a fourth line 25 of the process control unit 15. The output of the first AND-gate 24 is connected to the electro-motors 2.1 . . . 2.n of the servo drive belonging to the servo system 1 via the contact 28.1 . . . 28.n of the output multiplexer 28 corresponding to the signal E via a fifth line 29. Input signals are provided to the process control unit 15 with the signal H via a sixth line 33 from a manually actuated release unit 30 with the signal F via the seventh line 31 from the amount former 11 and with the signal G via the eighth line 32 from the first comparison circuit. The release unit 30 comprises a first key for releasing of the adjustment function and a second key for the release of the multiplicative adjustment function. A relais is connected to the first key and the contacts of the key form the switching group 34, the switching contact 40, the first switch 57 and the second switch 59, the third switch 60 and the fourth switch 61. This provides switching from the rest position into the operational position. The output of the analog digital converter 22 is formed as a cassette magnet tape and is coordinated on its output side to the output unit 4 connected to the process control unit 15.

Figure 2:
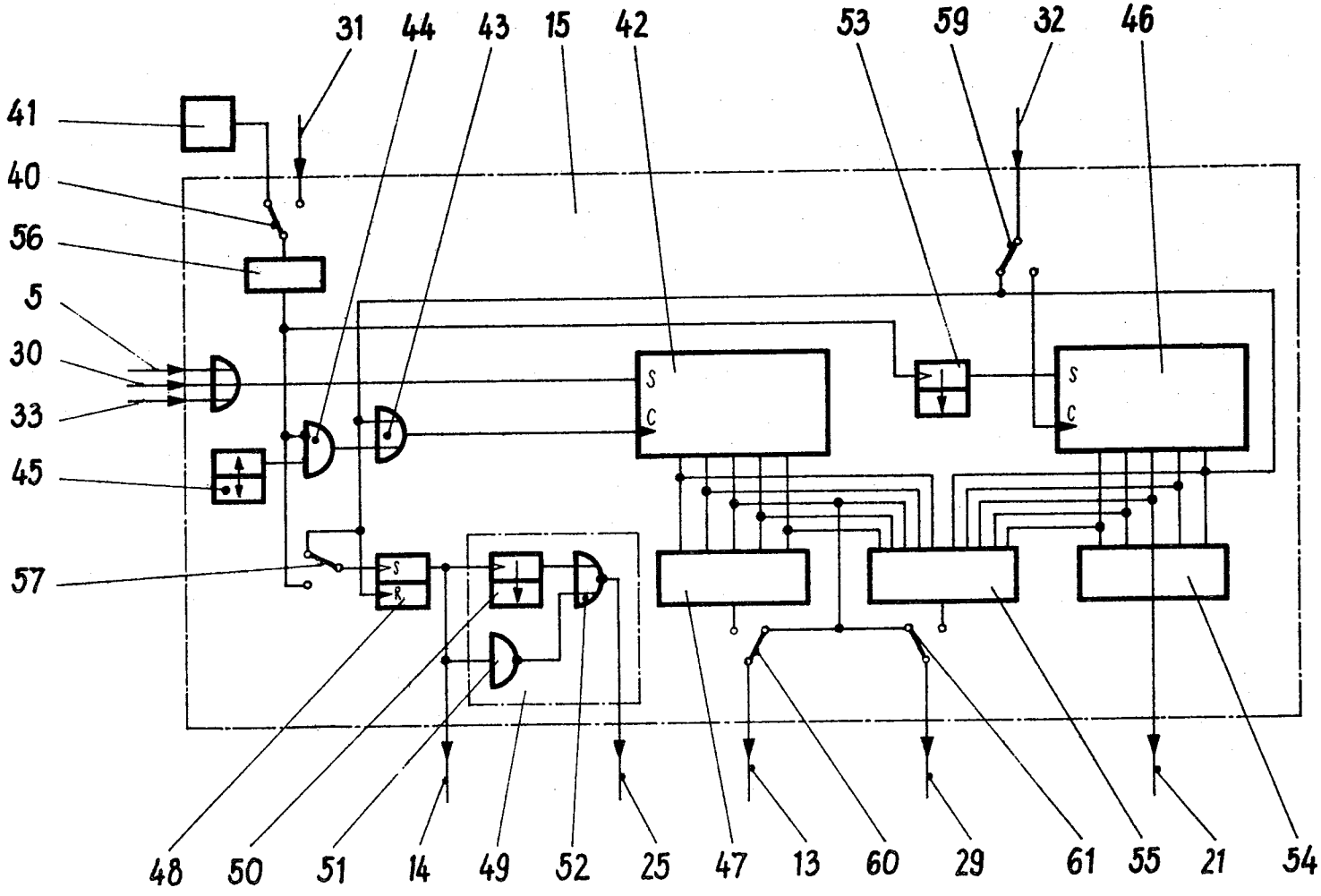
FIG. 2 is a view of a schematic circuit diagram for the process control.

FIG. 2 shows the process control unit 15. It is started with the signal H from the release unit 30 via the sixth line 33 at the counter 42. The counter 42 comprises a reset input, which is connected via an OR-gate 43 on the one hand to an astabile multivibrator 45 connected via a second AND-gate 44 controlled by a limiting value member 56 and on the other hand to the output of the shift register 46. The limiting value member 56 is connected to the output of the difference former via a seventh line 31 carrying the signal F. A switching contact 40 is disposed in the seventh line 31. In the rest position interrupting the seventh line, the input of the limiting value member 56 is connected to a provision 41 generating an L-signal. The outputs of the counter 42 provide via the first encoder 47 the signal A via the first line 13. An output of the shift register 46 is connected to the reset input of the bistable multivibrator 48, the set input of which also lends to the limiting value member 56. A first switch 57 is disposed in the input line to the set input of the bistable multivibrator 48, which connects in the rest position the set input with the feed line to the reset input and in operating position the set input to the output of the limiting member 56. The output of the bistable multivibrator 48 provides the signal B via the second line 14 and the input signal for a delay member 49, the output of which provides the signal D via the forth line 25. The delay member 49 comprises a first monostable multivibrator 50, a negator 51 and a NOR-gate 52. A set input of the shift register 46 is connected to the limiting value member 56 via a second monostable multivibrator 53. The reset input of the shift register 46 receives the signal G via the second switch 59 in the operation position from the eighth line 32. The eighth line 32 is connected to the output of the shift register 46 in the rest position of the second switch 59. The outputs of the shift register 46 provide via the second encoder 54 the signal C via the third line 21 and together with the outputs of the counter 42 via a third encoder 55 the signal E via the fifth line 29. A third switch 60 is disposed in the first line 13 and a fourth switch is disposed in the fifth line 29. In the rest position the recited switches connect the third output of the counter 42 to the lines 13 and 29. In the operating condition the recited switches connect the output of the first encoder 47 with the first line 13 and the output of the third encoder 55 with the fifth line 29.

The mode of operation of the provision is described in the following. Actuation of the first key of of the release unit 30 controls the relais 58 and therewith via the switch group 34, the switch contact 41 and the switches 57,59, 60 and 61 the provision is switched to the function adjustment. At the same time the signal H is generated by actuation of the first key of the sixth line 33. The contacts 16.1.1 . . . 16.n.2 of the first input multiplexer 6 of the first control system 7 started with the signal H of the manually actuated release unit 30 connect the measurement values of next to each other disposed two first potentiometers 3.1 . . . 3.n of the set point providing unit 3 belonging to the servo system 1 with the first difference amplifier 9 of the difference former 8 corresponding to the control by the signal A. Thus for example the two measurement voltages of the potentiometers 3.3 and 3.4 disposed next to each other are applied to the first difference amplifier 9 via the contacts 16.3.1 and 16.4.2. The difference voltage of the two measurement values is present at the output of the first difference amplifier 9 and is stored by the signal B in a first storage 10, which is formed as a generally known sample-hold circuit. A sample-hold circuit measures an input signal at a series of definite points in time and the output remains constant at a value corresponding to the most recent measurement until the next measurement is made. The amount of the difference voltage is present at the output of the amount former 11 and as a signal F at the process control unit 15. The amount former 11 can be constructed in known fashion with the aid of operational amplifiers. The amount is required for the determination of surpassings of limiting values in the process control unit 15. The set point for the adjustment of the unsteady course of the positions of the ink blade support elements to the steady function of the knife bending line is calculated from the difference voltage applied to the output of the first storage 10 in the first computing circuit 16 by way of an analog circuit comprising coefficient setting potentiometers 17.1 to 17.4 and following first operational amplifiers 18.1 to 18.4 for several of the servo systems 1 following on both sides. In the present case the calculation of four set point values of the corresponding servo systems is shown in FIG. 1. These set points are fed from the multiplexer 19 of the first motor control unit 21 via an analog digital converter 22 to the first comparison circuit 23. The only once present first motor control unit 20 is coordinated to the plurality of servo systems 1 on the input and outut side by way of the multiplexer 19 controlled by the process control unit 15 through the signal C. The first comparison circuit 23 is a forward-backward counter with an algebraic sign storage 23.1. The first comparison circuit 23 is set by the analog to digital converter 22 and then counted backward to zero with the pulses of the motor pulse provider 26. At zero the signal C is generated, which blocks the first AND-gate 24 for additional pulses of the motor pulse provider 26 and which influences the process control unit 15. Since the pulses of the motor pulse provider correspond to the actual position, the first comparison circuit 23 provides a comparison of set point to actual value. The motor pulse provider 26 is controlled by the signal D of the process control unit 15, where the algebraic sign storage 23.1 fixes the sense of rotation. The output multiplexer 28 controlled by the process control unit by way of signal E connects via the contacts 28.1 . . . 28.n with the electro-motors 2.1 . . . 2.n the servo drive 2 belonging to the servo system. In the case of the example the output multiplexer 28 coordinates the output of the first motor control unit to the electro-motors 2.2 to 2.5 via the contacts 28.2 to 28.5 up to the application of the signal G. If the course of the adjustment is finished, then the relais 58 falls down and the provision is switched to multiplicative adjustment. The provision is set to a fixed value of the percentage adjustment. For increasing of the adjustment value a plurality of releases is necessary. The provision can be employed both for positive as well as for negative percentage adjustment via plus-minus switch 37. The release of the course of the adjustment is provided via the second key of the release unit 30 or via the input and output unit 4. Thereby the measured value passes to the computing circuit 35 via the switch group 34. The calculated adjustment value is then processed further via the storage member 39 via the analog to digital converter 22 as described above. The first computing circuit 16 and the multiplexer 19 are thereby not in operation. The motors or respectively potentiometers belonging to the same servo system are continuously controlled via the first line 13 and the fifth line 29 such that a successive performance is provided. An L-signal is applied to the input of the limiting value member 56 and the second AND-gate 44 is thereby blocked. The second line 14 is switched further via the eigth line 32 and the second switch 59 and via the bistable multivibrator 59; at the same time the delay member 49 is switched further via the fourth line 25 such that the next servo system is operated after the percentage adjustment of a servo system.

It will be understood that each of the elements described above, or two or more together, may also find a useful application in other types of system configurations and ink feeding procedures differing from the types described above.

While the invention has been illustrated and described as embodied in a multiplicative adjustment provision at an ink feed remote control device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multiplicative adjustment provision at an ink feed remote control device with a servo system actuating doctor blade support elements, comprising a servo system including a servo drive;

a set point providing section;

a control system connected to the servo system and provided at its inputs and outputs with multiplexers including a motor control circuit;

a process control unit coordinating with the right sequence the motor control unit successively on the input and output side to the servo system;

a first computing circuit preceding the motor control unit;

a difference forming unit having input and output connected to the process control unit and having its output connected to the first computing circuit;

a switching means connected to the difference forming unit and connected to an input multiplexer of the control system; and a second computing circuit connected to the motor control unit and to the switching means.

2. The multiplicative adjustment provision according to claim 1, wherein the second computing circuit comprises connected in series a potentiometer connected to the switching means; a plus-minus switch connected to the potentiometer;

an operational amplifier connected to the plus-minus-switch and having an output;

a storage member connected to the output of the operational amplifier and to the control system.

* * * * *